United States Patent [19]

Dion

[11] 3,963,060

[45] June 15, 1976

[54] SHUTTLE DRIVE FOR A NARROW WARE LOOM

[75] Inventor: Raymond F. Dion, Greensboro, N.C.

[73] Assignee: Crompton & Knowles Corporation, Worcester, Mass.

[22] Filed: Jan. 21, 1975

[21] Appl. No.: 542,748

[52] U.S. Cl. ..... 139/137; 139/171; 139/341

[51] Int. Cl.[2] ..... D03D 35/00; D03D 43/00

[58] Field of Search ..... 139/135–141, 139/22, 23, 121, 119, 171, 341, 370, 371

[56] References Cited

UNITED STATES PATENTS

| | | | |
|---|---|---|---|
| 1,057,133 | 3/1913 | Emery | 139/137 |
| 2,132,758 | 10/1938 | Preston | 139/137 |
| 2,490,589 | 12/1949 | Gage et al. | 139/137 |
| 2,923,326 | 2/1960 | Kaffine | 139/137 |
| 3,012,588 | 12/1961 | Dupre | 139/371 |
| 3,565,126 | 2/1971 | Schlappi | 139/341 |
| 3,586,062 | 6/1971 | Hindle et al. | 139/171 |
| 3,757,831 | 9/1973 | Loepfe et al. | 139/341 |
| 3,856,055 | 12/1974 | Hirsch et al. | 139/138 |

FOREIGN PATENTS OR APPLICATIONS

| | | | |
|---|---|---|---|
| 691,927 | 5/1953 | United Kingdom | 139/341 |

*Primary Examiner*—James Kee Chi

[57] ABSTRACT

An improved shuttle drive for a narrow ware loom which includes a batten which is moved vertically in a pattern to one of several positions, a warp shed and a vertical row of shuttles mounted on the batten for vertical movement therewith and positioned so that only one of the shuttles is in active position for each position of the batten, the shuttles being mounted on the batten for horizontal movement through the warp shed. The improvement includes means for detecting which side of the shed the active shuttle is on, first actuating means for moving the active shuttle from one side of the warp shed, second actuating means for moving the shuttle to the opposite side of the warp shed and control means operatively connected to the detecting means for activating the appropriate actuating means.

18 Claims, 7 Drawing Figures

SHUTTLE DRIVE FOR A NARROW WARE LOOM

BACKGROUND OF THE INVENTION

This invention relates generally to narrow ware looms of the type where the shuttles are arranged in vertical rows across the width of a batten which is moved vertically in a pattern to one of several positions. There is a warp shed for each row of shuttles and the shuttles move vertically with the batten so that only one shuttle from each row of shuttles is aligned with a warp shed for each position of the batten. The shuttles at each level of the several rows are all driven together as a group through their respective warp sheds and in the same direction. This is accomplished by drive racks, one for each group of shuttles at the several vertical levels. The motion of the racks may be transferred to the shuttles by means of pinions which are interposed between the racks and matching gear teeth on the shuttles as shown, for example, in U.S. Pat. No. 2,132,758 dated Oct. 11, 1938 to F. W. Preston. Since the vertical rows of shuttles are moved in varied patterns, means must be provided for actuating the racks in either direction for each pick of the loom. Sometimes, due to the particular pattern used, the active shuttles will be pushed through the sheds from the same direction on successive picks. Each time the shuttles at one level are driven through their respective sheds from one direction, they must be driven through their respective sheds from the opposite direction the next time that they are in the active position with respect to their respective warp sheds.

To provide the capability of driving the rack which corresponds to the active shuttles in either direction, very elaborate drive mechanisms have been developed. One such drive mechanism is shown in U.S. Pat. No. 1,057,133 dated Mar. 25, 1913 to A. Emery. The drive mechanism shown in this patent is typical of many of the mechanical rack drives which employ positive actuating elements for moving the rack in either direction for each pick. Latching means are employed for operatively connecting the actuating elements to the rack so that only one of the actuating elements will be effective to drive the rack in only one direction. The latching means are arranged so that the position of the rack will determine which latch will effectively connect its actuating mechanism to the rack. The latches themselves are spring loaded and one problem which frequently occurs is that when one of the springs fails, both latches may engage the rack so that both actuating mechanisms try to drive the rack at the same time in opposite directions, resulting in serious damage to various drive elements.

The problems encountered in mechanical drives of the type described above have been overcome by providing fluid pressure rack driving means which drive the racks individually in accordance with a pattern. An example of this type of rack drive is shown in U.S. Pat. No. 2,923,326 dated Feb. 2, 1960 to H. O. Kaffine. However, this type of rack shuttle drive is very complicated and expensive.

SUMMARY OF THE INVENTION

It is a principle objective of the present invention to produce rack shuttle drive mechanisms which will overcome all of the problems encountered with prior art of rack drives and which is simple, inexpensive, and reliably operable.

The principle objective of the invention is accomplished by providing a first actuator for driving the "active" rack in one direction, a second actuator for driving the active rack in a second direction, means for detecting which side of the shed the active shuttles are on, and control means operatively connected to the detecting means for actuating only the one of said first and second actuators which will be effective to move the active shuttles to the other side of their respective warp sheds. Specifically, the detecting means are switches which are positioned to detect either the position of the active shuttle, or the position of the active rack, or its associated parts. The actuators are fluid pressure elements controlled by valves and solenoids under control of the detecting switches.

DETAILED DESCRIPTION OF THE INVENTION

Figure 1:
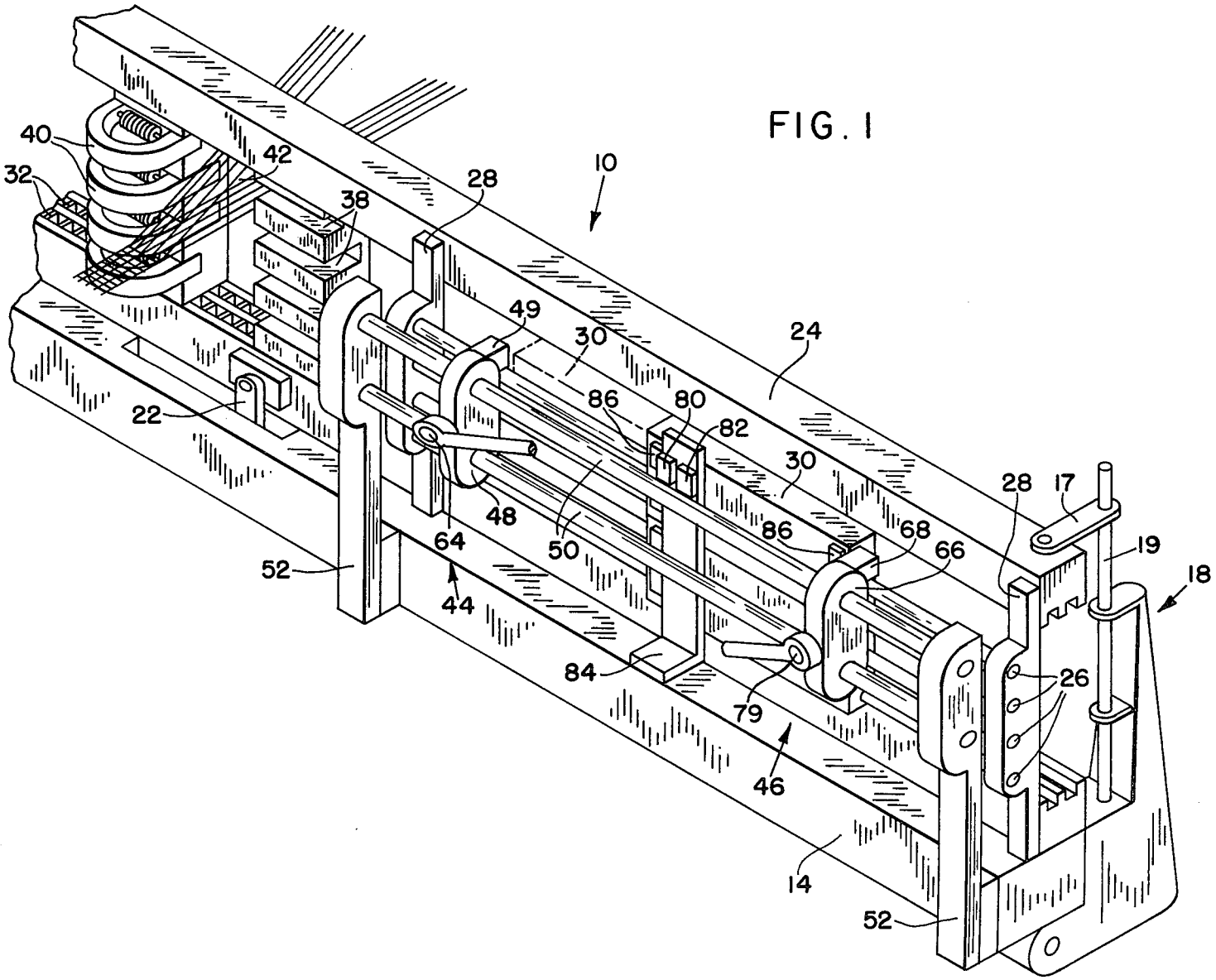
FIG. 1 is a fragmentary perspective of a portion of a batten with the invention applied thereto.

Referring particularly to FIGS. 1, 2, 3 and 6, there is shown a narrow ware loom of the type to which the invention is applied, generally indicated by the reference numeral 10. This loom includes a frame 12, batten supporting means 14 pivotally mounted on the frame as at 16, and a batten 18 mounted for vertical movement relative to the supporting means 14 by means of links 17 which are pivotally attached to the batten and slidably mounted on guide rods 19 which are fixed to the supporting means 14 at various points along the length of the batten. The supporting means 14 are reciprocated around pivot 16 once for each pick by crank means 20 operatively connected to the loom drive means, not shown.

Batten 18 is moved vertically relative to supporting means 14 by means of linkage 22 operably connected to suitable pattern mechanism, not shown. The pattern mechanism may be of any type as shown, for example, in the aforementioned U.S. Pat. to Kaffine.

Figure 2:
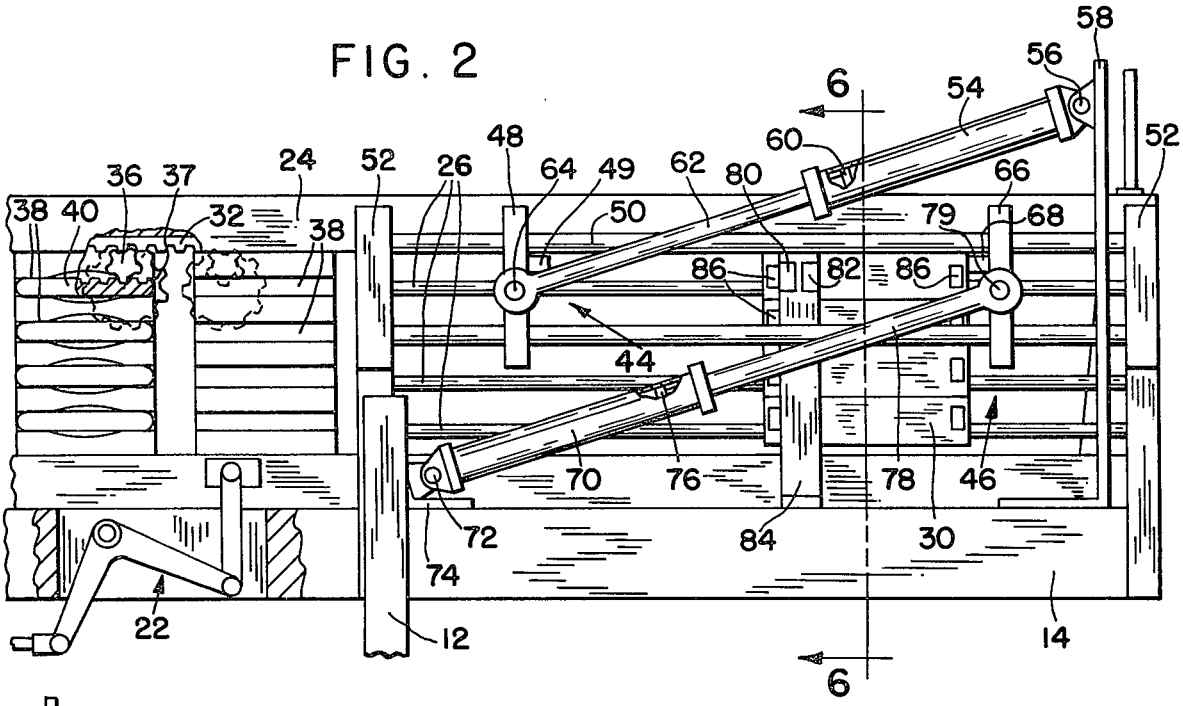
FIG. 2 is a fragmentary front elevation of a position of a loom batten with the invention applied thereto.
Figure 3:
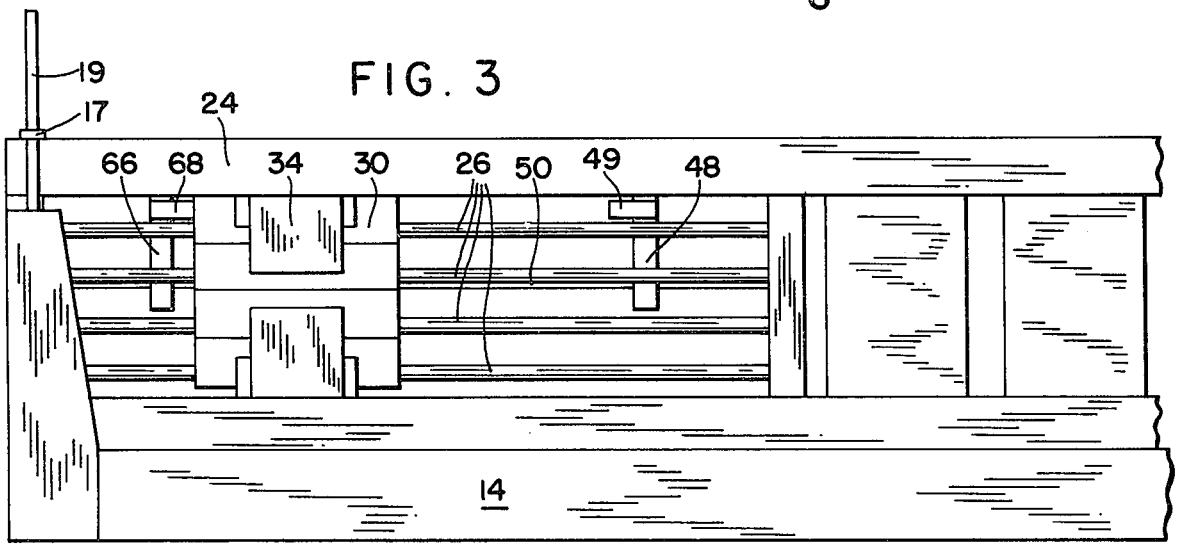
FIG. 3 is a fragmentary rear elevation thereof.

Batten 18 comprises a frame 24, and horizontal spindles 26 mounted between vertical supporting brackets 28 which are fixed to the frame 24. A lug 30 is slidably mounted on each spindle 26 for horizontal movement relative to the batten. Each lug 30 is fixed to a horizontal rack 32 by a connecting link 34, see particularly FIG. 6. Spindles 26 are arranged in a vertical row and there is one spindle for each rack 32. Racks 32 are slidably mounted in framework 24 for drivingly engaging pinions 36 and 37 rotatably mounted in shuttle boxes 38 arranged in vertical rows within the framework 24. Located within shuttle boxes 38 are shuttles 40 which have gear teeth on their outer surfaces for engagement with pinions 36 and 37. The racks 32 are arranged in upper and lower pairs within the framework 24. The uppermost and lowermost shuttles are driven by pinions 36 which are in engagement with an upper rack and lower rack, respectively, and the middle two shuttles are driven by the relatively larger pinions 37 which are in engagement with the remaining upper and lower racks, see particularly FIG. 2. Movement of a rack to the left, as shown in FIG. 2, will cause each of its respective shuttles to move from the shuttle box that it is in to the adjacent shuttle box to the right. Movement of a rack 32 to the right will cause each of its respective shuttles to move from the shuttle box that it is in to the adjacent shuttle box to the left. Only one group of shuttles and two groups of shuttle boxes are illustrated in FIG. 2, it being understood that additional groups of shuttles and shuttle boxes are arranged throughout the length of the batten 18.

Between each group of shuttle boxes there is a warp shed 42. Each of the shuttle contains a diverse weft yarn; and the batten will be moved to various vertical positions in accordance with the pattern mechanism so that only one shuttle from each vertical group of shuttles will be aligned with its respective warp shed 42 for each vertical position of the batten. The aligned shuttle for each group will be considered the active shuttle and will be moved horizontally through its respective warp shed 42 upon horizontal movement of its respective rack 32. Since the batten may be moved in varied patterns, it is possible that shuttles may be moved through the warp sheds from the same direction on successive picks. However, each shuttle of a group of shuttles will be moved through its respective shed alternately to the right and to the left as viewed in FIG. 2.

Lugs 30, and subsequently shuttles 40, are moved horizontally by means of a first and second actuators generally indicated by the referrence numerals 44 and 46, respectively. First actuator 44 comprises a sliding block 48 which has a projecting portion 49 and is slidably mounted on two horizontal rods 50 rigidly mounted between a pair of vertical brackets 52 fixed to supporting means 14. First actuator 44 also includes an air cylinder 54 pivotally connected at 56 to a vertical bracket 58 fixed to batten supporting means 14. A piston 60 is slidably mounted within cylinder 54 and has an extending portion 62 which is pivotally attached at 64 to sliding block 48.

Second actuator 46 comprises a sliding block 66 which has a projecting portion 68 and is slidably mounted on rods 50. Second actuator 46 also comprises an air cylinder 70 pivotally attached at 72 to a bracket 74 which is fixed to the batten supporting means 14. A piston 76 is slidably mounted within cylinder 70 and has an extending portion 78 which is pivotally attached at 79 to block 66.

Air cylinders 54 and 70 are double acting cylinders wherein their respective extending portions 62 and 78 move inwardly thereinto for an actuating stroke and outwardly therefrom for a return stroke. First and second actuators 44 and 46 are positioned on horizontal rods 50 so that extending portion 49 of the first actuator will be moved to the right, as shown in FIG. 1, during an actuating stroke; and projecting portion 68 of the second actuator will be moved toward the left, as viewed in FIG. 1, for an actuating stroke. Projecting portion 49 will be moved to the left and projecting portion 68 will be moved to the right, as viewed in FIG. 1, for return strokes of cylinders 54 and 70, respectively. In FIG. 1, first and second actuators are shown in the positions that they occupy after return strokes of the cylinders. The means for controlling the operation of cylinders 54 and 70 will be described in detail hereinafter.

As the batten 18 is moved vertically to its several positions, lugs 30 will also move vertically to the same degree. Lugs 30 are positioned so that one of the lugs is aligned along a horizontal axis with both of the projections 49 and 68 for each position of the batten. For each position of the batten, one of the shuttles of each vertical group is considered the active shuttle and the lug which corresponds to the active shuttle will be aligned with projections 49 and 68 and is considered the active lug. If the active lug is to the right, as shown in FIG. 1, then it will be moved to the left by projecting portion 68 during an actuating stroke of cylinder 70. This will move the corresponding active shuttle to the right through its corresponding warp shed. If the active lug 30 is positioned to the left, as viewed in FIG. 1, it will be moved to the right by projecting portion 49 during an actuating stroke of cylinder 54. This will cause its respective active shuttles to be moved to the left, as viewed in FIG. 1, through their respective warp sheds.

First actuator 44, together with racks 32, lugs 30, and pinions 36 and 37, are considered first actuating means for moving the active shuttles through their respective warp sheds in a first direction; and the second actuator 44, together with racks 32, lugs 30, and pinions 36 and 37, are considered second actuating means for moving the active shuttles through their respective warp sheds in a second direction.

Sensing means and controls means are employed, which will determine which of the actuators will be actuated in accordance with the position of the active lug.

The means for sensing which side of the warp shed the active shuttles are on, or the position of their corresponding lug, comprises two magnetically operated switches 80 and 82 mounted on a bracket 84 fixed to batten supporting means 14. Switches 80 and 82 are of the type which is normally open and closes in the presence of a magnetic field. One such type of switch is commonly known as a "reed switch". However, the invention is not limited to any particular type of switch. Mechanically operated limit switches could also be used if desired. The detecting switches could be of the type which has a switch arm or plunger which causes the switch to close when depressed. The motion of lugs 30 would be effective to depress the plunger or arm of a mechanically operated switch. Magnets 86 are fixed to both ends of each lug so that when the active lug is in the right hand position, as shown in FIG. 1, switch 80 will be closed by the magnet at the left hand end of the lug; and when the active lug is in its left hand position, as shown by dot and dash lines in FIG. 1, switch 82 will be closed by the magnet at the right end of the active lug.

Figure 7:
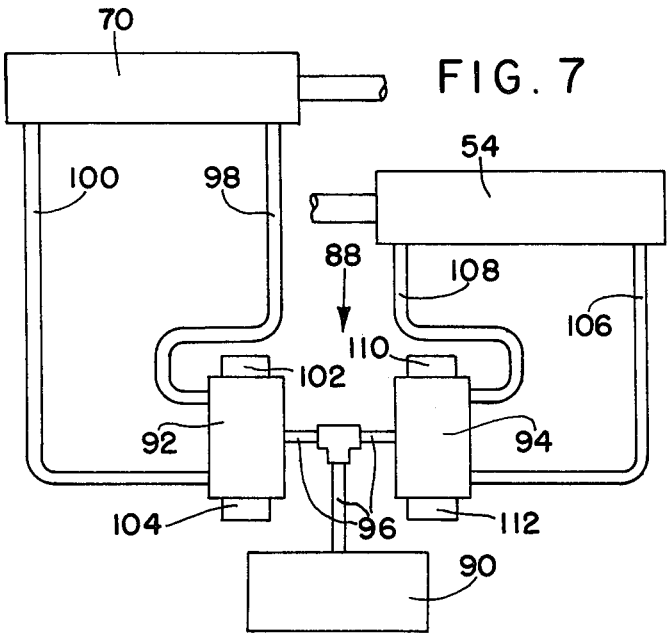
FIG. 7 is a diagrammatic view of part of the controls for the first and second actuators.

Referring particularly to FIG. 7, there is illustrated control means generally indicated by the reference numeral 88 for operating cylinders 54 and 70. Control means 88 comprise a source of compressed air 90 and solenoid operated valves 92 and 94 which are connected to the source of compressed air 90 by air line 96. Valves 92 and 94 are so-called three-way valves which have two operating positions and are controlled by pairs of solenoids. Valve 92 is connected to opposite ends of cylinder 70 by air lines 98 and 100. When valve 92 is in a first position, it will be effective to connect the inner end of cylinder 70 to the air source 90 through line 98 for an actuating stroke; and when in a second position, it will be effective to connect the outer end of cylinder 70 to source 90 through air line 100 for a return stroke. A solenoid 102 mounted at one end is effective, when energized, to move valve 92 to its first operating position and a solenoid 104 at the opposite end of the valve is effective, when energized, to move valve 92 to its second operating position. Valve 94 is connected to cylinder 54 by air lines 106 and 108 respectively, and is effective in a first operating position to connect the inner end of cylinder 54 to source 90 through air line 108 for an actuating stroke; and effective in a second operating position to connect the outer end of cylinder 54 to source 90 through air line 106 for a return stroke. A solenoid 110 is mounted on one end of valve 94 and is effective, when energized, to move valve 94 to its first operating position and a solenoid 112 is attached to the opposite end of valve 94 and effective, when energized, to move valve 94 to its second operating position.

Although a pneumatic system is employed for the actuator, it is contemplated that hydraulic cylinders and valves could also be used.

Figure 8:
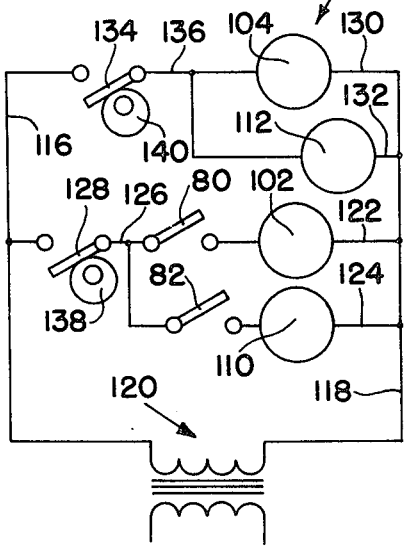
FIG. 8 is a wiring diagram for the detecting switches and control means for the actuators.

Referring to FIG. 8, there is shown a wiring diagram for the control means disclosed in FIG. 7 and for the detecting means shown in FIG. 1. The circuit in FIG. 8 is generally indicated by reference numeral 114 and comprises a pair of power lines 116 and 118 connected to a source of power generally indicated at 120. Solenoids 102 and 110 are connected to power line 118 via lines 122 and 124, respectively. Switches 80 and 82 are also located on lines 122 and 124, respectively, and are effective when closed to connect solenoids 102 and 110, respectively, to a line 126. A normally open switch 128 is located on line 126 and is effective when closed to connect line 126 to power line 116 thereby completing a circuit between power lines 116 and 118 through either line 122 or line 124, depending on whether switch 80 or 82 is closed. Solenoids 104 and 112 are connected to power line 118 via lines 130 and 132, respectively. A line 136 is connected to both lines 130 and 132 and power line 116 and contains a switch 134 which is effective when closed to complete a circuit between power lines 116 and 118 along lines 130 and 132, thereby energizing solenoids 104 and 112. Energization of solenoids 104 and 112 will move valves 94 and 104 to their second operating positions. Switches 128 and 134 are opened and closed by cams 138 and 140, respectively. These cams are operated in timed relation with the operation of the loom and make one revolution for each pick.

During operation of the loom, switch 128 will be closed by cam 138 at the appropriate time when the sheds for each group are in the open position. One of the switches 80 and 82 will be closed by one of the magnets 86 of the active lug 30. If the active lug is to the right, as shown in FIG. 1, switch 80 will be closed by the magnet 86 at the left end of the active lug 30 and solenoid 102 will be energized. This will move valve 92 to its first operating position, which connects line 98 to a source 90 and provides cylinder 70 with an actuating stroke.

If the active lug is to the left, as shown in dotted lines in FIG. 1, switch 82 will be closed by the magnet 86 at the right end of the active lug 30 and solenoid 110 will be energized. This will move valve 94 to its first operating position, which connects line 108 to source 90 and provides cylinder 54 with an actuating stroke. Movement of the active lug by an actuating stroke of the appropriate cylinder will cause the rack 32, to which it is attached, to move the corresponding active shuttle from each group of shuttles to move through its respective warp shed. After the active shuttles have passed through their respective warp sheds switch 134 will be closed by cam 140 and solenoids 104 and 112 will be energized. This will cause valves 92 and 94 to be moved to their second operating positions, thereby connecting cylinders 54 and 70 to source 90 for a return stroke. However, only one of the pistons 60 and 76 will actually be moved since only one of them was moved in an actuating stroke. This will insure that both pistons will be in their return position within their respective cylinders and the projecting portions 49 and 68 of first and second actuators, respectively, will be in the ready position, as shown in FIG. 1, for each pick, regardless which actuator operated last.

Figure 4:
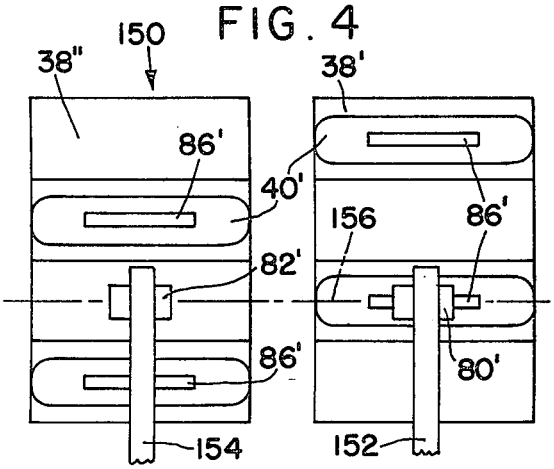
FIG. 4 is a diagrammatic representation of a first modified detecting means.

Referring to FIG. 4, a first modified sensing means is generally indicated by the reference numeral 150 and comprises magnets 86' attached to shuttles 40' and magnetically operated switches 80' and 82' which are identical to switches 80 and 82. Switch 80' is located on a vertical bracket 152 which is fixed to batten supporting means 14 and is adjacent to the last group of shuttle boxes indicated at 38' at one end of the batten. Switch 82' is located on a vertical bracket 154 which is fixed to batten supporting means 14 and is adjacent to the next to last group of shuttle boxes indicated at 38'' at the same end of the batten. Switches 80' and 82' are positioned so that they lie in a horizontal plane which intersects the warp sheds, the edge of the plane being indicated by dot and dash line 156. Only the last group of shuttles are equipped with magnets 86'. When the active shuttle is in shuttle box group 38', switch 80' will be closed by the magnet 86' of the active shuttle. Whenever the active shuttle is in shuttle box group 38'', switch 82' will be closed by the magnet 86' of the active shuttle. Switches 80' and 82' replace switches 80 and 82, respectively, in circuit 114 and function in exactly the same manner as switches 80 and 82 for controlling the operation of the first and second actuators 44 and 46.

Figure 5:
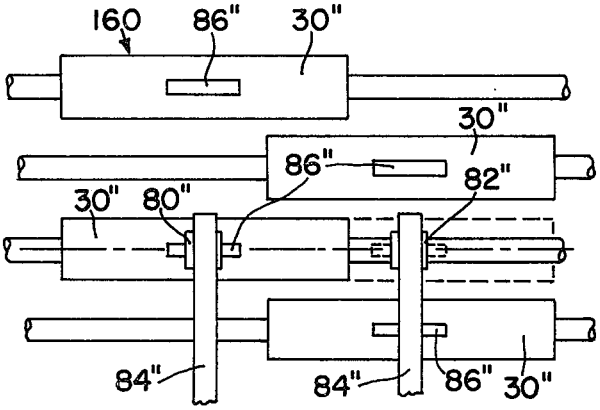
FIG. 5 is a diagrammatic representation of a second modified detecting means.
Figure 6:
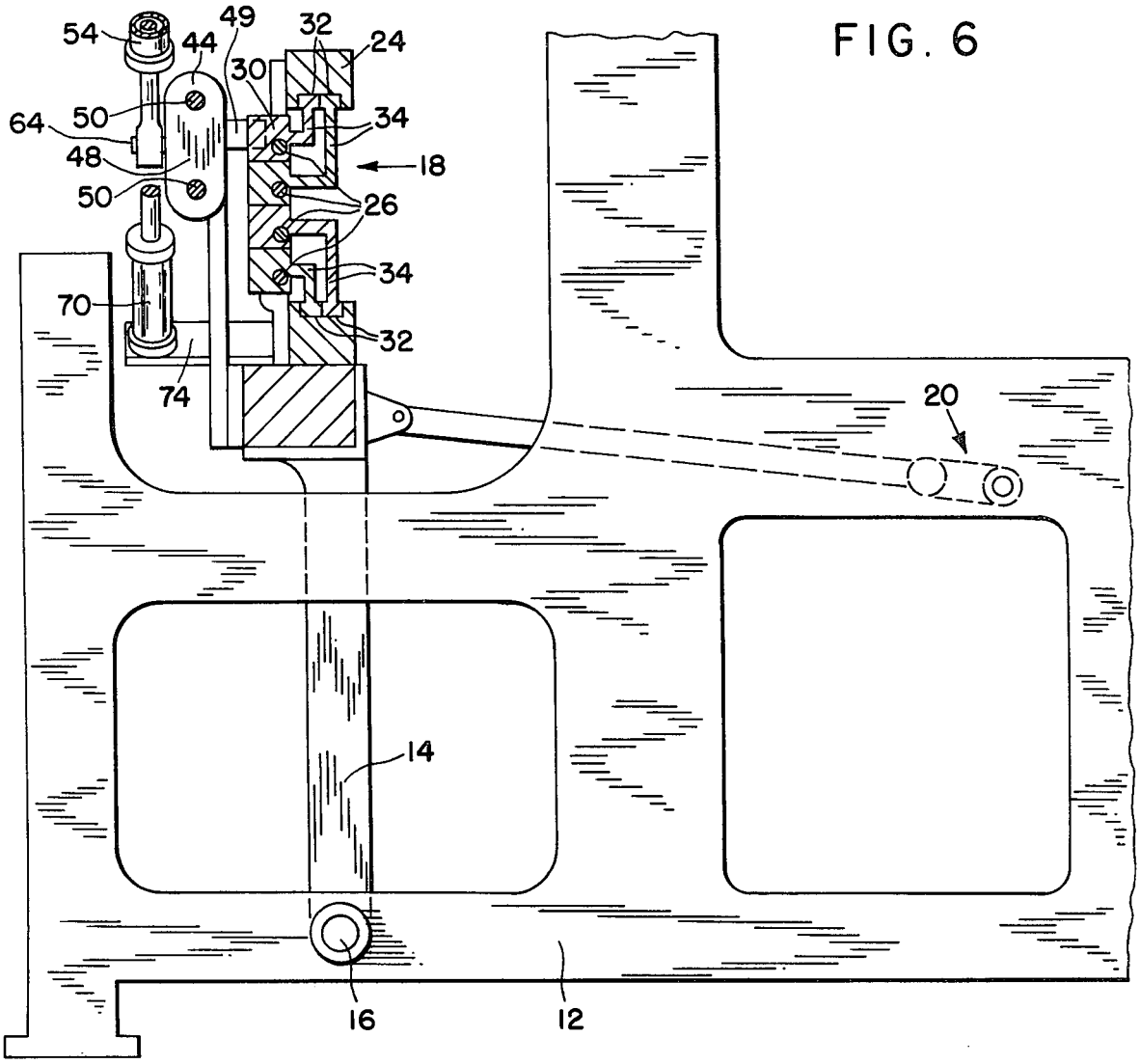
FIG. 6 is a vertical section taken along line 6—6 in FIG. 2 looking in the direction of the arrows.

Referring to FIG. 5, a second modified sensing means is generally indicated by the reference numeral 160 and comprises magnets 86' mounted centrally on lugs 30'' and switches 80'' and 82'' mounted on vertical brackets 84'' fixed to batten supporting means 14 in the same manner as bracket 84 in FIG. 1. Lugs 30'' are identical to lugs 30 in FIG. 1. Switches 80'' and 82'' are mounted on brackets 84'' in the same horizontal plane as switches 80 and 82. However, brackets 84'' are sufficiently spaced so that the magnet 86'' on the active lug 30'' will close switch 80'' when the active lug 30'' is in the left-hand, or dotted line, position, as viewed in FIG. 1. Switch 82'' will be closed by the magnet 86'' on the active lug when the active lug is in the right-hand, or full line, position, as viewed in FIG. 1. Switches 80'' and 82'' replace switches 80 and 82, respectively, in circuit 114 and function in exactly the same manner as switches 80 and 82 for controlling the operation of the first and second actuators 44 and 46.

What is claimed is:

1. In a narrow ware loom having a frame, a warp shed, batten supporting means pivotally mounted on the frame, a batten mounted on said supporting means for vertical movement relative to said supporting means to any one of several positions, and a plurality of shuttles mounted on said batten for vertical movement therewith and for horizontal movement on said batten from a first side of said warp to a second side thereof, said shuttles being vertically spaced from each other so that only one of said shuttles is active by being aligned with said warp shed for each of the several positions of said batten, means for moving said active shuttle through said warp shed comprising:

a. means for detecting whether the active shuttle is on the first or second side of said warp shed;
b. first actuating means mounted on said supporting means for horizontal movement relative thereto for moving said active shuttle from the first side of said warp shed to the second side thereof;
c. second actuating means mounted on said supporting means for horizontal movement relative thereto for moving said active shuttle from the second side of said warp shed to the first side thereof;
d. control means operatively connected to said detecting means for activating said first actuating means when said active shuttle is on the first side of said warp shed and for activating said second actuating means when the active shuttle is on the second side of said warp shed.

2. In a narrow ware loom having a frame, a warp shed, batten supporting means pivotally mounted on the frame, a batten mounted on said supporting means for vertical movement relative to said supporting means to any one of several positions, and a plurality of shuttles mounted on said batten for vertical movement therewith and for horizontal movement on said batten from a first side of said warp shed to a second side thereof, said shuttles being vertically spaced from each other so that only one of said shuttles is active by being aligned with said warp shed for each of the several positions of said batten, means for moving said active shuttle through said warp shed comprising:

a. a drive for each of said shuttles, mounted on said batten for movement vertically therewith and longitudinally thereof between a first position and a second position, each of said drives being operably connected to its corresponding shuttle so that when the drive is in its first position, its corresponding shuttle is on the first side of said warp shed and when the drive is in its second position, its corresponding shuttle is on the second side of said warp shed;
b. means for detecting whether the active shuttle is on the first or second side of said warp shed;
c. a first actuator for moving the drive which corresponds to the active shuttle from its first position to its second position;
d. a second actuator for moving the drive which corresponds to the active shuttle from its second position to its first position; and
e. control means operatively connected to said detecting means for activating said first actuator when the active shuttle is on the first side of said warp shed for activating said second actuator when the active shuttle is on the second side of said warp shed.

3. In a narrow ware loom having a batten which is moved vertically to one of several positions in a pattern, a warp shed and a vertical row of shuttles mounted on said batten for vertical movement therewith and positioned so that only one of said shuttles is active by being aligned with said warp shed for each of the several positions of said batten, means for moving said active shuttle through said warp shed between first and second sides thereof comprising:

a. a lug for each of said shuttles which move as a group along a first axis through a second actuating axis, which is transverse to said first axis, in the same pattern as said shuttles so that only the lug which corresponds to said active shuttle lies along said second axis and is the active lug, each of said lugs being independently movable between a first position and a second position along said second axis;
b. drive means operatively connecting said lugs to said shuttles so that when any one of said lugs is in said first position, its corresponding shuttle is on said first side of said shed and when any one of said lugs is in said second position, its corresponding shuttle is on said second side of said shed;
c. means for detecting whether said active lug is in said first or second position;
d. a first actuator for moving said active lug from said first position to said second position;
e. a second actuator for moving said active lug from said second position to said fist position; and
f. control means operatively connected to said detecting means for activating said first actuator when said active lug is in said first position and for activating said second actuator when said active lug is in said second position.

4. In a narrow ware loom having a batten which is moved vertically to one of several positions in a pattern, a warp shed and a vertical row of shuttles mounted on said batten for vertical movement therewith and positioned so that only one of said shuttles is active by being aligned with said warp shed for each of the several positions of said batten, means for moving said aligned shuttle through said shed between first and second sides thereof comprising:

a. a lug for each of said shuttles which move as a group along a first axis through a second actuating axis, which is transverse to said first axis, in the same pattern as said shuttles so that only the lug which corresponds to said active shuttle lies along said second axis and is the active lug, each of said lugs being independently movable between a first position and a second position along said second axis;
b. drive means operatively connecting said lugs to said shuttles so that when said active lug is in said first position, its correponding shuttle is on said first side of said warp shed and when said active lug is in said second position, its corresponding shuttle is on said second side of said warp shed;
c. means for detecting whether said active lug is in said first or second position; and
d. actuator means and control means therefor which are operatively connected to said detecting means for shifting said active lug from whichever of said first and second position it is in to the other side of said positions.

5. In a narrow ware loom as set forth in claim 4 wherein said detecting means comprises:

a. a first switch which is normally open and which is closed when said active lug is in said first position; and
b. a second switch which is normally open and which is closed when said active lug is in said second position.

6. In a narrow ware loom as set forth in claim 4 wherein said detecting means comprises:
a. a first normally open magnetically actuated switch which closes in a magnetic field;
b. a second normally open magnetically actuated switch which closes in a magnetic field; and
c. magnetic means for each of said lugs, each of said first magnetic means being operatively connected to its respective lug so that it is effective to close said first switch only when said lug is active and in said first position and to close said second switch only when said lug is active and in said second position.

7. In a narrow ware loom as set forth in claim 4 wherein said actuating means comprises:
a. a first pusher slidably mounted on said batten in engaging alignment with said active lug;
b. a first fluid cylinder;
c. a first piston slidably mounted in said first cylinder and operatively connected to said first pusher;
d. a second pusher slidably mounted on said batten in engaging alignment with said active lug;
e. a second fluid cylinder; and
f. a second piston slidably mounted in said second cylinder and operatively connected to said second pusher.

8. In a narrow ware loom as set forth in claim 7 wherein said fluid cylinders are air operated cylinders and said control means comprise:
a. a source of air at super atmospheric pressure;
b. a first valve having an actuating position and a return position and effective in said actuating position for connecting said first cylinder to said source of air for an actuating stroke of said first piston; and
c. a second valve having an actuating position and a return position and effective in said actuating position for connecting said second cylinder to said source of air for an actuating stroke of said second piston.

9. In a narrow ware loom as set forth in claim 8 wherein said detecting means comprise:
a. a first switch which is normally open and which is closed when said active lug is in said first position; and
b. a second switch which is normally open and which is closed when said active lug is in said second position.

10. In a narrow ware loom as set forth in claim 9 wherein said first and second valves are solenoid operated valves and said control means includes electrical control means which comprise:
a. a timer switch;
b. a first solenoid which is actuated upon closing of said timer switch and said first switch for moving said first valve to said actuating position; and
c. a second solenoid which is actuated upon closing of said timer switch and said second switch for moving said second valve to said actuating position.

11. In a narrow ware loom as set forth in claim 9 wherein said first and second switches are magnetically actuated switches which close in a magnetic field and said detecting means further comprise magnetic means for each of said lugs, each of said magnetic means being operatively connected to its respective lug so that it is effective to close said first switch only when said lug is active and in said first position and to close said second magnet only when said lug is active and in said second position.

12. In a narrow ware loom as set forth in claim 7 wherein said fluid cylinders are double acting air cylinders and said control means comprise:
a. a source of air at super atmospheric pressure;
b. a first three-way valve which has an actuating position for connecting one end of said first cylinder to said source for an actuating stroke of said first piston and a return position for connecting the opposite end of said first cylinder to said source for a return stroke of said first piston; and
c. a second three-way valve which has an actuating position for connecting one end of said second cylinder to said source for an actuating stroke and a return position for connecting the opposite end of said second cylinder to said source for a return stroke.

13. In a narrow ware loom as set forth in claim 12 wherein said detecting means comprise:
a. a first switch which is normally open and which is closed when said active lug is in said first position; and
b. a second switch which is normally open and which is closed when said active lug is in said second position.

14. In a narrow ware loom as set forth in claim 13 wherein said first and second valves are solenoid operated valves and said control means include electrical control means which comprise:
a. a first solenoid which is connected in series with said first switch for shifting said first three-way valve to its actuating position:
b. a second solenoid which is connected in series with said second switch for shifting said second three-way valve to its actuating position;
c. a third solenoid for shifting said first three-way valve to its return position;
d. a fourth solenoid for shifting said second three-way valve to its return position; and
e. timer switch means for energizing said first solenoid when said first switch is closed and said second solenoid when said second switch is closed for an actuating stroke of either said first or second pistons and for energizing said third and fourth solenoids for a return strike of said actuated first or second piston, said third and fourth solenoids being energized as a pair alternately with either said first or second solenoids.

15. In a narrow ware loom as set forth in claim 14 wherein said timer switch means comprises:
a. a double pole, double throw switch; and
b. a cam for actuating said timer switch wherein said cam makes one rotation for each traverse of a shuttle through said shed.

16. In a narrow ware loom as set forth in claim 7 wherein said fluid cylinders are double acting cylinders and said control means comprise:
a. a first valve connected to said first fluid cylinder and which has an actuating position which causes said first piston to be moved in an actuating stroke and a return second position which causes said first piston to be moved in a return stroke; and
b. a second valve connected to said second fluid cylinder and which has an actuating position which causes said second piston to be moved in an actuating stroke and a return position which causes said second piston to be moved in a return stroke.

17. In a narrow ware loom as set forth in claim 16 wherein said detecting means comprise:

a. a first switch which is normally open and which is closed when said active lug is in said first position; and b. a second switch which is normally open and which is closed when said active lug is in said second position.

18. In a narrow ware loom as set forth in claim 17 wherein said first and second valves are solenoid operated valves and said control means include electrical control means which comprise:

a. a first solenoid which is connected in series with said first switch for shifting said first valve to its actuating position;

b. a second solenoid which is connected in series with said second switch for shifting said second valve to its actuating position;

c. a third solenoid for shifting said first three-way valve to its return position;

d. a fourth solenoid for shifting said second three-way valve to its return position; and e. timer switch means for energizing said first solenoid when said first switch is closed and said second solenoid when said second switch is closed for an actuating stroke of either said first or second pistons and for energizing said third and fourth solenoids for a return stroke of said actuated first or second piston, said third and fourth solenoids being energized as a pair alternately with either said first or second solenoids.

* * * * *